United States Patent [19]

Heitmann

[11] Patent Number: 5,072,742

[45] Date of Patent: Dec. 17, 1991

[54] METHOD OF AND APPARATUS FOR MAKING A FILLER OF SMOKABLE MATERIAL

[75] Inventor: Uwe Heitmann, Hamburg, Fed. Rep. of Germany

[73] Assignee: Körber AG, Hamburg, Fed. Rep. of Germany

[21] Appl. No.: 671,128

[22] Filed: Mar. 18, 1991

[30] Foreign Application Priority Data

Mar. 23, 1990 [DE] Fed. Rep. of Germany ..... 4009381

[51] Int. Cl.[5] ..... A24C 5/18

[52] U.S. Cl. ..... 131/84.3; 131/84.1; 131/84.4; 131/110

[58] Field of Search ..... 131/84.1, 84.3, 84.4, 131/108, 110

[56] References Cited

U.S. PATENT DOCUMENTS 3,779,253 12/1973 Labbe ..... 131/110
3,957,062 5/1976 Labbe et al. ..... 131/84.3
4,417,594 11/1983 Garrone ..... 131/84.4
4,693,263 9/1987 Wahle et al. ..... 131/84.4
4,697,603 10/1987 Steinhauer et al. ..... 131/108
4,741,350 5/1988 Belvederi ..... 131/84.3

*Primary Examiner*—Vincent Millin
*Assistant Examiner*—Lynne A. Reichard
*Attorney, Agent, or Firm*—Peter K. Kontler

[57] ABSTRACT

A cigarette rod making machine wherein the surplus of smokable material which is removed by the trimming device is returned into the magazine of the distributor next to the supply of fresh tobacco. Fresh tobacco is withdrawn from the supply in the form of a relatively wide first layer, and the returned surplus is removed in the form of a narrower second layer adjacent one marginal portion of the first layer. The two layers are converted into a stream which advanced toward and past the trimming device in such a way that the latter removes mainly recirculated surplus tobacco which is again admitted into the magazine for conversion into the second layer.

20 Claims, 3 Drawing Sheets

METHOD OF AND APPARATUS FOR MAKING A FILLER OF SMOKABLE MATERIAL

BACKGROUND OF THE INVENTION

The invention relates to improvements in methods of and in apparatus for producing a continuous rod-like filler from particles of smokable material, particularly for producing a continuous rod-like filler which consists of or contains predominantly tobacco shreds and is ready to be converted into a cigarette rod.

It is well known to make a rod-like tobacco filler by drawing particles of tobacco from a suitable source so that the particles form a relatively wide and relatively thin layer which is thereupon converted into a rather narrow and tall stream containing a surplus of tobacco. The surplus is removed by a suitable trimming or equalizing device so that the remainder of the stream constitutes a rod-like filler which is ready to be condensed and draped into a web of cigarette paper or other wrapping material. The resulting cigarette rod is severed at desirable intervals to yield plain cigarettes of unit length or multiple unit length. Analogous steps are or can be carried out to form cigars, cigarillos, cheroots and other rod-shaped smokers' products. The removed surplus is returned into the source and is mixed with fresh tobacco prior to being conveyed to the converting station as a part of the layer.

On their way from the source to the station where the layer is converted into a stream, the particles of tobacco in the layer are normally subjected to one or more separating or singularizing treatments in order to eliminate batches or other accumulations and to thus permit the formation of a homogeneous stream which can be used to constitute the filler of a high-quality cigarette rod. As a rule, the transporting system for tobacco particles includes an endless belt conveyor which gathers successive increments of the layer into successive increments of the stream and transports the stream toward and past the trimming device. The stream can be built at the underside of the lower reach of the endless belt conveyor and is then attracted by suction to advance above the trimming device which removes the surplus at the irregular underside of the stream. The source of tobacco particles is part of a distributor (also called hopper) which receives batches of fresh tobacco particles at required intervals to thus ensure that the distributor establishes and maintains a substantially constant supply of tobacco particles in the form of shreds and, at times, a certain percentage of comminuted tobacco ribs. Proper recirculation of removed surplus tobacco into the distributor and its admixture to fresh tobacco particles (so that the removed surplus is thereupon incorporated into the rod-like filler) often presents many problems, particularly as concerns the uniformity of distribution of normally shorter particles of surplus tobacco in the filler.

OBJECTS OF THE INVENTION

An object of the invention is to provide a novel and improved method of forming a continuous rod-like filler of smokable material in such a way that the surplus which is removed by the trimming device cannot affect the quality of the filler and of rod-shaped smokers' products which are obtained by subdividing the wrapped filler into plain cigarettes or the like.

Another object of the invention is to provide a novel and improved method of manipulating surplus tobacco in a cigarette rod making machine or an analogous machine for the production of rod-shaped smokers' products.

A further object of the invention is to provide a novel and improved method of circulating surplus tobacco particles in a cigarette rod making or like machine.

An additional object of the invention is to provide a novel and improved method of conveying different types of tobacco particles in a cigarette rod making or like machine.

Still another object of the invention is to provide a novel and improved machine for the making of tobacco filler rods.

A further object of the invention is to provide a novel and improved distributor or hopper for use in a cigarette rod making or like machine.

Another object of the invention is to provide a filler making machine with novel and improved means for recirculating surplus tobacco from and back to the surplus removing station.

An additional object is to provide a novel and improved filler which is obtained in accordance with the method and in the apparatus of the present invention.

A further object of the invention is to provide the apparatus with novel and improved means for automatically mixing fresh and removed surplus tobacco when the ratio of fresh tobacco to surplus tobacco in the filler departs from an optimum ratio or from an acceptable range of ratios.

Another object of the invention is to provide the apparatus with novel and improved means for effecting optimal guidance of freshly supplied and recirculated tobacco particles on their way toward the surplus removing station.

SUMMARY OF THE INVENTION

One feature of the present invention resides in the provision of a method of producing a continuous rod-like filler from particles of smokable material, particularly shreds of tobacco leaf laminae. The method comprises the steps of establishing and maintaining a supply of smokable material, continuously drawing a first layer of material from the supply and transporting the first layer in a predetermined direction along an elongated path wherein the first layer has two marginal portions, converting in a first portion of the path successive increments of the moving first layer into successive increments of a relatively narrow and tall stream which contains a surplus of smokable material, removing the surplus from the stream in a second portion of the path downstream of the first portion so that the remainder of the stream constitutes a continuous filler, and returning the removed surplus into a third portion of the path upstream of the first portion and at one marginal portion of the first layer so that the returned surplus forms a second layer along the first layer and reenters the first portion of the path.

The transporting step preferably comprises advancing the stream on a conveyor (e.g., at the underside of the lower reach of an endless foraminous belt conveyor) and the converting step then comprises transferring successive increments of the first layer onto the conveyor prior to transfer of successive increments of the second layer so that the converted first layer is transformed into a first portion of the stream next to the conveyor and the second layer is transformed into a second portion of the stream on top of the first portion (i.e., more distant from the conveyor). The removing step of such method includes removing smokable material from the second portion of the stream (i.e., from the portion which contains recirculated surplus smokable material).

The returning step preferably includes placing the second layer immediately or very closely adjacent the one marginal portion of the first layer. This is desirable and advantageous because it renders it possible to effect the transfer (migration) of smokable material from the first layer into the second layer when the ratio of smokable material in the first layer to smokable material in the second layer is on the increase, or to effect the transfer (migration) of smokable material from the second layer into the first layer when the ratio of smokable material in the second layer to smokable material in the first layer is on the increase.

The transporting step can include advancing the first and second layers next to each other downwardly through a gathering duct which is installed upstream of the first portion of the path.

The transporting step can also comprise pneumatically conveying the first and second layers to the first portion of the path (namely toward the stream building station on the conveyor) along an arcuate (preferably at least partially concave) guide surface at which the two layers are advanced along discrete parallel neighboring sections of the path.

The maintaining step can include admitting into the supply fresh smokable material along a second path at a level above but laterally offset from the surplus which is being returned into the third portion of the path for the two layers and the stream.

Another feature of the invention resides in the provision of an apparatus for producing a continuous rod-like filler from particles (e.g., shreds) of smokable material. The improved apparatus comprises a source of supply of smokable material (e.g., a magazine in the distributor or hopper of a cigarette rod making machine), means for continuously drawing a first layer of smokable material from the source and for transporting the first layer in a predetermined direction along an elongated path wherein the first layer has two marginal portions, means for converting in a first portion of the path successive increments of the first layer into successive increments of a relatively narrow and tall stream which contains a surplus of smokable material (the converting means can include a suction chamber which attracts successive increments of the first layer to the underside of the lower reach of the aforementioned endless foraminous belt conveyor), means for removing the surplus from the stream in a second portion of the path downstream of the first portion so that the remainder of the stream constitutes a continuous substantially rod-like filler which is ready to be draped into cigarette paper or other suitable wrapping material, and means for returning the removed surplus into a third portion of the path upstream of the first portion and at one marginal portion of the first layer so that the returned surplus forms a second layer along the first layer and reenters the first (and thereupon the second) portion of the path.

The transporting means can comprise the aforementioned endless conveyor which receives successive increments of the first and second layers in the first portion of the path. Such transporting means preferably further comprises means (such as a plate-like guide) for delivering successive increments of the first layer to the conveyor ahead of successive increments of the second layer so that the converted first layer is transformed into a first portion of the stream next to the conveyor and the second layer is transformed into a second portion of the stream on top of the first portion (i.e., the second portion overlies the first portion and is more distant from the conveyor). The removing means of such apparatus preferably includes means for removing smokable material from the second portion of the stream, i.e., from recirculated surplus material.

The returning means is preferably designed to place returned smokable material into immediate proximity to the one marginal portion of the first layer. The arrangement may be such that the returning means includes means for delivering surplus material at least close to the source, and the path which is defined by the transporting means is preferably designed to permit migration of surplus material from the second layer into the first layer when the ratio of smokable material in the second layer to material in the first layer is on the increase or to permit migration of smokable material from the first layer into the second layer when the ratio of smokable material in the first layer to smokable material in the second layer is on the increase.

The transporting means can include the aforementioned gathering duct wherein the first and second layers advance next to each other in a downward direction upstream of the first portion of the path.

The transporting means can further include the aforementioned arcuate surface and means for pneumatically conveying the first and second layers along the arcuate surface toward the first portion of the path. The surface can define parallel first and second neighboring sections of the path for the first and second layers, respectively.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
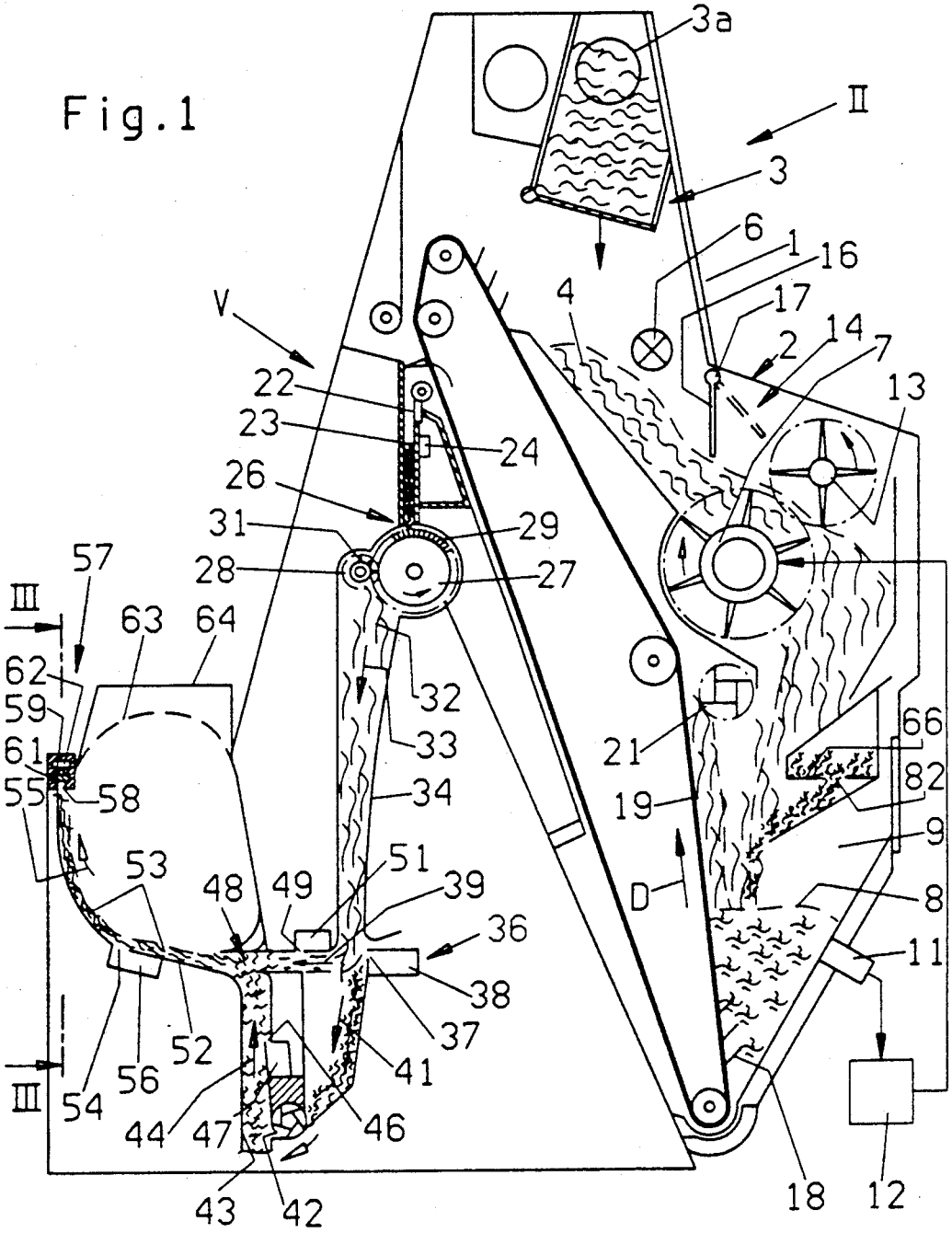
FIG. 1 is a partly elevational and partly transverse vertical sectional view of a cigarette rod making machine which embodies the invention.

The drawing shows an apparatus which constitutes a cigarette rod making machine wherein a stream **78+78*a* (FIG. 3) consisting of particles of smokable material (normally shreds of tobacco leaf laminae with some comminuted tobacco ribs added thereto) is converted into a rod-like filler 78*c* (FIG. 3) and the filler is thereupon draped into a web 91** of cigarette paper or other suitable wrapping material to form a continuous cigarette rod which is ready to be subdivided into plain cigarettes of unit length or multiple unit length in a manner not forming part of the invention.

The apparatus of FIGS. 1 to 3 comprises a distributor V (also called hopper) including a magazine 9 constituting a source of supply 8 of comminuted tobacco particles (hereinafter called shreds for short but with the understanding that other types of particles, i.e., not necessarily in the form of shreds, can be processed with the same or similar advantage without departing from the spirit of the invention). The distributor V further comprises a housing or casing 1 for the magazine 9 and for a so-called predistributor 2 which is located beneath a gate or a system of gates 3 receiving fresh tobacco shreds from a pneumatic conveyor 3*a* and being operative to discharge, at required intervals, batches of tobacco shreds into the predistributor 2 so that the latter establishes and maintains a supply 4 of tobacco shreds. The arrangement is preferably such that the gate or gates 3 automatically discharge one or more batches or similar accumulations of tobacco shreds as soon as the upper level of the supply 4 in the predistributor 2 descends below the level of a monitoring device 6, e.g., a detector employing a photoelectronic transducer. This ensures that the supply 4 of tobacco shreds remains at least substantially constant.

The housing 1 further contains a metering wheel 7 which can be said to constitute a rotary rake and serves to transfer tobacco shreds from the supply 4 into the magazine 9. FIG. 1 shows the entire metering wheel 7 but FIG. 2 merely shows a phantom line 7′ denoting the locus of horizontal axis of the metering wheel. The supply 8 of tobacco shreds in the magazine 9 is monitored by a battery of horizontally aligned detectors 11 preferably comprising photoelectronic transducers which transmit signals to a control circuit 12. The latter controls the operation of a motor 107 for the metering wheel 7 in such a way that the wheel 7 comes to a standstill when the three detectors 11 are beneath the level of the upper surface of the supply 8, that the wheel 7 is driven at half the maximum speed when two detectors 11 are confined in the supply 8 (see the line 8*a* in FIG. 2), and that the wheel 7 is driven at a nominal (maximum) speed when all three detectors 11 are exposed. Such regulation of the transfer of fresh tobacco shreds from the supply 4 within the predistributor 2 into the supply 8 in the magazine 9 ensures that the level of the top surface of the supply 8 fluctuates only within a relatively narrow range.

Figure 2:
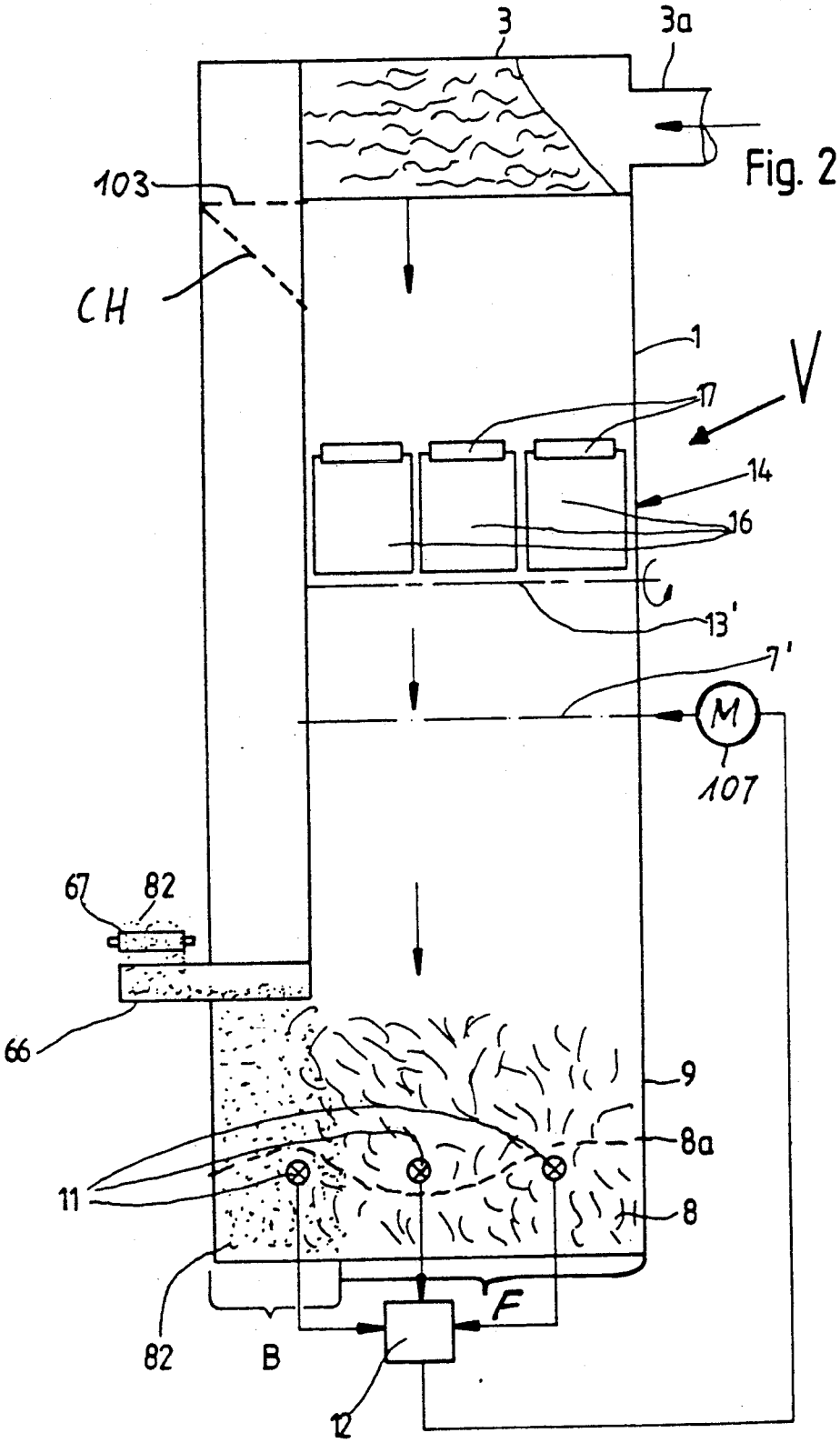
FIG. 2 is a view in the interior of the distributor substantially as seen in the direction of arrow II in FIG. 1.

In order to ensure long-range uniform replenishing of the supply 8 with finely distributed (disentangled) fresh tobacco shreds, the housing 1 of the distributor V further confines combing or equalizing roller 13 (the axis of this roller is indicated in FIG. 2 by a horizontal phantom line 13′) which is driven (e.g., by a takeoff of the motor 107) counter to the direction of rotation of the metering wheel 7. The roller 13 transfers tobacco shreds from the supply 4 into the magazine 9 without interruptions, i.e., also when the metering wheel 7 is at a standstill.

Figure 3:
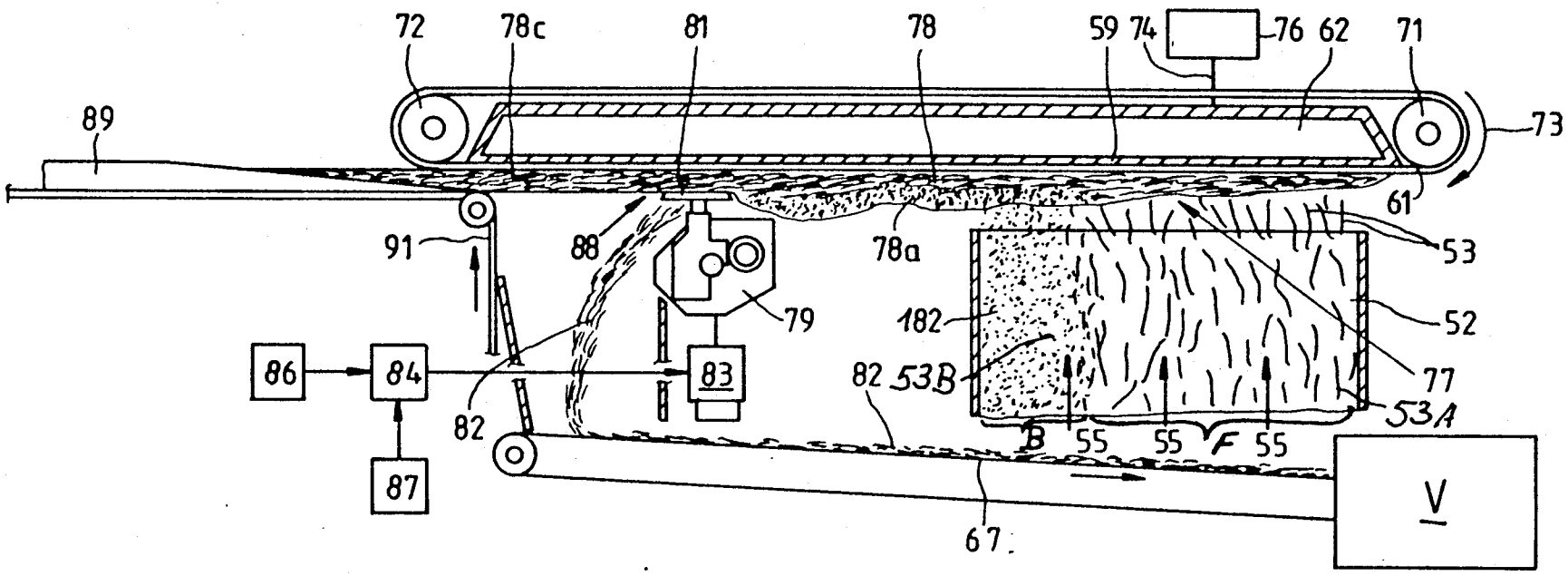
FIG. 3 is an enlarged longitudinal vertical sectional view substantially as seen in the direction of arrows from the line III—III in FIG. 1.

The housing 1 further accommodates a yieldable composite barrier 14 which, in the apparatus of FIGS. 1 to 3, comprises three panels or flaps 16 which are suspended on and are pivotable about the axes of three coaxial horizontal shafts 17. The lower portions of the freely pivotable flaps 16 extend into the path of the flow of tobacco shreds in the supply 4 toward the upper portion of the metering wheel 7 and into the nip of this metering wheel with the combing roller 13. The flaps 16 prevent batches, clumps or similar accumulations of coherent (interlaced) tobacco shreds from descending into the range of the orbiting teeth or vanes of the wheel 7 and roller 13 and from eventually clogging the passage for transfer of shreds into the supply 8 in the magazine 9. The flaps 16 can yield individually in response to pressure which is applied by the flowing mass of tobacco shreds to effect at least some (coarse) distribution of tobacco shreds in the axial direction of the wheel 7 and to thus enable the wheel and the combing roller 13 to break up eventual clumps or batches into smaller accumulations which are broken up again during advancement through the nip of the wheel 7 and roller 13 on their way into the magazine 9. The flaps 16 exhibit the additional advantage that they effectively oppose and prevent stratification of different types of shreds in the magazine 9, i.e., a gathering of shreds of the same type in different portions of the magazine (particularly as seen in the direction of the axes 7′ and 13′). The aforedescribed component parts of the distributor V ensure that the supply 8 in the magazine 9 contains a mass of finely distributed and substantially loose particles which can be processed to form a uniform rod-like filler 78*c*.

The distributor V further comprises an endless belt or chain conveyor 19 which is trained over a set of pulleys (shown but not referenced in FIG. 1) and performs the function of an elevator by moving predetermined quantities of tobacco shreds from the magazine 9 into a substantially upright and relatively narrow gathering duct 22. The conveyor 19 is provided with entraining elements 18 which define pockets for relatively small batches of tobacco shreds and entrain such batches from the magazine 9 (arrow D) to dump the batches into the open upper end of the duct 22. The batches which are entrained by the elements 18 are equalized by the vanes or paddles of a paddle wheel 21 which is adjacent the ascending reach of the elevator conveyor 19 and brushes the surplus back into the supply 8 in the magazine 9.

The relatively narrow and relatively tall accumulation 23 of tobacco shreds in the duct 22 is monitored by a set of detectors 24 (each such detector can comprise a radiation source and a photoelectronic transducer) which transmit signals to the motor (not specifically shown) for the elevator conveyor 19 so that the level of the top surface of the accumulation 23 in the duct 22 remains substantially unchanged.

The means for withdrawing the lowermost portion of the accumulation 23 by way of the outlet 26 at the lower end of the duct 22 comprises a customary carded wheel 27 and a picker roller 28. The rotational speed of the picker roller 28 greatly exceeds the rotational speed of the carded wheel 27. The pins 31 of the roller 28 serve to expel tobacco shreds from the carding 29 of the wheel 27 so that the thus expelled shreds form a shower 32 which descends (note the arrow 33 in FIG. 1) in a downwardly tapering funnel-shaped enclosure or channel 34 which condenses the shower and leads it into the range of a classifying device 36 including a plenum chamber 38 and one or more nozzles 37 which discharge jets or streamlets of compressed air in the direction of arrow 39. The jets of compressed air form a pneumatic curtain which is traversed by descending heavier particles (such as fragments of tobacco ribs) but which entrains the lighter particles (primarily or exclusively shreds of tobacco leaf laminae if the apparatus of FIGS. 1 to 3 is used to make a high-quality rod-like filler 78*c* for the making of plain cigarettes). The heavier particles descend in the direction of arrow 41 and pass through a driven cell wheel 42 on their way into the lower portion of an upright duct 43.

As a rule, heavier particles which descend beyond the classifying device 36 in the direction of arrow 41 entrain some lightweight particles (shreds) into the duct 43. Such lightweight particles are lifted in the duct 43 due to the injector effect of one or more nozzles 46 which are provided in a plenum chamber 47 to discharge jets or streamlets of compressed air into the duct 43 so that the jets flow upwardly (arrow 44) and entrain the lighter particles into a junction zone 48 wherein the thus lifted lightweight particles are intermixed with the bulk of lightweight particles advancing in the direction of arrow 39. The jets of compressed air which are discharged by the nozzle or nozzles 37 of the classifying device 36 are sufficiently strong to ensure that the resulting mixture of shreds leaves the junction zone 48 in the direction of arrow 39 and forms a relatively thin but relatively wide first layer 53 flowing along the normally at least slightly or at least partially concave upper side or surface of a stationary or vibrating guide 52.

The flow of tobacco shreds in the direction of arrow 39 is promoted by one or more additional pneumatic propelling units including a plenum chamber 51 with one or more nozzles 49 immediately or shortly ahead of the junction zone 48 and a plenum chamber 56 with one or more nozzles 54 at the guide 52. The first layer 53 closely follows the upper side or surface of the guide 52 and advances in the direction of arrows 55 toward and into a stream building zone 77 which is shown in the left-hand portion of FIG. 1 and in the right-hand portion of FIG. 3.

The layer 53 advances beyond the guide 52 and is converted into a portion **78*a* of a continuous relatively narrow and relatively tall stream 78+78*a* at the underside of the lower reach of an endless foraminous belt conveyor 61 forming part of a pneumatic conveying or transporting unit 57. The lower reach of the conveyor 61 is caused to advance (note the arrow 73 in FIG. 3) at the bottom (actually in the top portion) of an elongated narrow tobacco channel 58 and at the underside of a perforated bottom wall 59 (the perforations are not shown in FIG. 3) of a suction chamber 62. The latter is installed between the upper and lower reaches of the foraminous conveyor 61 and has an outlet 74 connected with a suction generating device 76, e.g., with the suction intake of a fan. The surplus of compressed air which is supplied by the nozzles 37, 46, 49 and 54 leaves the space above the guide 52 by penetrating through a sieve or filter 63 on its way into an expansion chamber 64**.

FIG. 3 shows that the first layer 53 (which consists mainly or exclusively of properly classified high-quality tobacco shreds) overlies only a (major) portion of the concave side or surface of the guide 52. This layer has a first marginal portion at 53A and a second marginal portion at 53B. The width of the layer 53 is shown at F in each of FIGS. 2 and 3; such width is measured at right angles to the plane of FIG. 1. Successive increments of the layer 53 are converted into successive increments of the major or upper portion 78 of the stream **78+78*a* which is being built in the zone 77 at the underside of the lower reach of the conveyor 61 to advance in the direction of arrow 73. The conveyor 61 is trained over pulleys 71, 72 at least one of which is driven in a conventional manner to advance the lower reach in the direction of arrow 73, namely past the upper end of the guide 52 and on toward an adjustable surplus removing trimming or equalizing device 79 of known design. The trimming device 79 can comprise a pair of cooperating horizontal disc-shaped pinching members 81 (one shown in FIG. 3) which are driven to rotate about vertical axes and to engage opposite sides of the stream 78+78*a* in a trimming plane 88. The trimming device 79 further comprises a paddle wheel (not shown) which is located beneath the pinching members 81 and brushes away the surplus 82 which projects downwardly beyond the trimming plane 88. A motor 83 is provided to change (when necessary) the level of the plane 88 and to thus enable the trimming device 79 to remove larger or smaller quantities of surplus 82**.

The motor 83 receives signals from a regulator 84 which compares actual value signals (furnished by a detector 86 and denoting the mass of successive increments of the filler **78*c*) with signals from a source 87 of reference signals denoting the desired or necessary mass of successive increments of the filler. The motor 83 alters the level of the trimming plane 88 when the regulator 84 detects that the actual-value signals from the detector 86 deviate from reference signals which are transmitted by the source 87. The trimming plane 88 is moved up or down, depending on the (positive or negative) character of signals which are transmitted by the regulator 84**.

The trimmed stream **78+78*a* (i.e., the filler 78*c*) is advanced onto the continuous web 91 of cigarette paper which is draped around the filler in a wrapping mechanism 89** (also called format) so that the filler and the draped web constitute a continuous cigarette rod which is subdivided by a standard cutoff to yield plain cigarettes of unit length or multiple unit length.

The surplus 82 which is removed from the stream **78+78*a* is returned into the distributor V (and more particularly into the magazine 9) by an endless belt conveyor 67 which has a receiving end beneath the trimming device 79 and a discharge end serving to deliver the removed surplus onto a vibratory conveyor 66 (FIGS. 1 and 2) in the housing 1 at a level beneath the gate or gates 3. The conveyor 66 has a slit-shaped inclined outlet which discharges surplus tobacco 82 into the magazine 9 at a location adjacent one marginal portion of the elevator conveyor 19. The arrangement is such that the returned surplus 82 advances along the same path as the shreds which are to form the first layer 53 and that the surplus 82 ultimately forms a second layer 182 (FIG. 3) which is immediately adjacent one marginal portion (53B) of the layer 53 and its conversion into a portion of the stream 78+78*a* results in the formation of a top portion 78*a* overlying that side or surface (namely the underside) of the main portion 78 which is nearer to the lower reach of the conveyor 61 than the portion 78*a*. The height of the top portion 78*a* is not regular but this portion is removed, either entirely or in part, by the trimming device 79 so that the once recirculated surplus 82 (i.e., the stream portion 78*a*) is removed again and is reintroduced into the distributor V by the conveyors 67, 66** of the surplus removing means.

The width B of the second layer 182 is or can be a small fraction of the width F of the first layer 53, i.e., tobacco shreds which form the layer 53 can constitute the bulk or the major portion of the stream **78+78*a* ahead of the station for the trimming device 79. FIG. 2 shows that the left-hand portion of the magazine 9 (namely the portion which is reserved for returned surplus tobacco shreds 82**) does not receive fresh tobacco shreds from the gate or gates 3, predistributor 2 and transferring means including the metering wheel 7 and combing roller 13. In other words, the length of the gate or gates 3, metering wheel 7 and combing roller 13 can be less than the width of the magazine 9 and the width of the elevator conveyor 19.

The formation of the first and second layers 53 and 182 can be said to begin as early as on the elevator conveyor 19 and is clearly discernible in the duct 22 wherein the layers 53 and 182 descend toward the carding 29 of the wheel 27 in immediate or very close proximity to each other. The shreds which form the surplus 82 and the layer 182 could but need not be subjected to the action of the classifying device 36 since they are devoid of heavier particles. FIG. 3 shows that the layers 53 and 182 constitute two discrete shallow or thin but relatively wide advancing masses of shreds to thus ensure that successive increments of the layer 53 are converted into the stream portion 78 containing high-quality smokable material and that the normally shorter shreds of the layer 182 form the stream portion 78*a* on top of the stream portion 78 and are thus advanced into the range of the trimming device 79 for removal from the remainder (filler 78*c*) of the stream 78+78*a* and for recirculation into the distributor V. This ensures that at least the major part of the filler 78*c* consists of tobacco shreds which were contained in the first layer 53, i.e., of tobacco shreds which have entered the magazine 9 on their way from the gate or gates 3 and through the predistributor 2 rather than by way of the conveyors 67 and 66, i.e., from the (surplus removing) station for the trimming device 79.

It has been found that, though the stream of surplus tobacco 82 on the conveyors 67, 66 and the mass or surplus tobacco 82 in the corresponding portion of the magazine 9 contain a higher percentage of shorts than the filler 78*c*, the length of shreds in the surplus 82 and in the layer 182 is not unduly reduced. Thus, once the length of shreds in the surplus 82 has been reduced to a certain extent, such length remains more or less unchanged primarily because the shorter shreds are drawn by air flowing upwardly in the channel 58, through the lower reach of the conveyor 61 and into the suction chamber 62, i.e., such air entrains the relatively short shreds of the layer 182 into the gaps of the stream portion 78. This is desirable on several grounds, for example, because the conveyors 67, 66 do not recirculate short or very short tobacco particles and because the short particles which have penetrated into the stream portion 78 enhance the quality (uniformity) of the filler 78*c* and the so-called standard deviation of weight.

If the ratio of the quantity of tobacco in the layer 182 to the quantity of shreds in the layer 53 increases (e.g., as a result of upward shifting of the trimming plane 88), the particles of the layer 182 migrate into the layer 53. Inversely, particles of the layer 53 migrate into the layer 182 if the balance between the quantities of tobacco in the layers 53 and 182 is shifted in the opposite direction. There is ample room for such automatic migration along the path for the shreds from the supply 8 in the magazine 9 and the neighboring path for recirculated surplus tobacco 82 from the corresponding portion of the magazine 9 into the tobacco channel 58. An advantage of the just discussed automatic migration of tobacco shreds from the layer 53 into the layer 182 or in the opposite direction is that the quantity of shreds in the untrimmed stream 78+78*a* does not fluctuate to an extent which could affect the quality of the filler 78*c*, e.g., in that the conveyor 61 would fail to deliver a required minimum quantity of tobacco shreds into the range of the trimming device 79.

In order to ensure predictable and reliable withdrawal of the surplus 82 from the corresponding portion of the magazine 9, those entraining elements 18 which serve to lift particles of the recirculated surplus 82 are or can be placed nearer to each other than the entraining elements 18 for those shreds which are to be withdrawn from the supply 8.

FIG. 2 shows that the gate or gates 3 are located only at a level above that portion of the magazine 9 which receives fresh shreds from the nip of the metering wheel 7 and combing roller 13, i.e., from the supply 4 of fresh shreds in the predistributor 2. If it is desired to employ a standard gate or a standard system of gates 3 which extend across the full width of the magazine 9 and predistributor 2 (note the extension 103 in FIG. 2), the apparatus can comprise a suitably inclined chute CH (indicated in FIG. 2 by a broken line) or a horizontal vibratory conveyor (analogous to the conveyor 66) with a suitably sloping discharge end to direct fresh tobacco shreds from the leftmost portion of the gate or gates (above the left-hand portion of the magazine 9) into the range of the flaps 16 and hence into the part 2 of the distributor V. The chute CH or the vibratory conveyor can be designed and mounted to ensure desirable distribution of deflected tobacco shreds in the supply 4.

The level and inclination of the chute CH or of a functional equivalent of this chute can be selected in such a way that fresh shreds which are supplied by the extension 103 of the gate or gates 3 are permitted to reach the supply 8 in the magazine 9 only at the level of the vibratory conveyor 66 of the surplus returning means 66–67. The gate or gates extend across the full width of the housing 1 in a conventional distributor V so that, if the illustrated gate or gates 3 are mounted in the same way as in a conventional distributor, they can deliver a large quantity of fresh tobacco shreds which are properly distributed across the width of the layer 53 by the chute CH or its functional equivalent(s) to prevent penetration of fresh shreds (or of an appreciable quantity of fresh shreds) into that portion of the magazine 9 which is reserved for surplus tobacco 82 descending from the outlet of the vibratory conveyor 66.

An important advantage of the improved apparatus is that it is not necessary to establish a mechanical barrier in the form of a wall or partition to separate the layers 53 and 182 from one another. This is desirable on several grounds, for example, because it is not necessary to modify numerous component parts of a standard apparatus and also because shreds are free to migrate from the layer 53 into the layer 182 or vice versa when such migration is desirable and advantageous in order to prevent excessive fluctuations of the height of the stream 78+78*a*. Thus, it is possible to uniformize the combined layer 53+182 without resorting to complex monitoring and regulating equipment. In other words, the mass of tobacco particles which reach the stream building zone 77 can remain at least substantially constant even if the ratio of quantity of particles in the layer 182 relative to the quantity of particles in the layer 53 happens to increase or decrease. Migration of tobacco particles from the layer 53 into the layer 182 or in the opposite direction can be achieved in several portions of the path along which the particles are transported from the magazine 9 to the stream building zone, for example, in the duct 22 wherein the two layers are immediately adjacent each other, on the surface of the guide 52 (i.e., immediately ahead of the channel 58 for the lower reach of the conveyor 61), but particularly in the magazine 9 under the influence of the elevator conveyor 19. Tobacco particles which are entrained by the elevator conveyor 19 perform a sort of rolling movement whereby one component of the movement of fresh tobacco can wander into the region of movement of returned surplus tobacco 82 if the ratio of fresh tobacco to returned surplus tobacco increases, and vice versa. Due to such effect, it is not necessary that one component of movement of fresh tobacco or of returned surplus tobacco greatly exceed a component of movement of returned surplus tobacco or fresh tobacco before the migration of tobacco from the path for the layer 53 into the path for the layer 182 (or vice versa) begins. The migration takes place as a result of the development of a natural angle of repose.

Another important advantage of the improved method and apparatus is that a relatively small percentage of freshly supplied shreds (delivered by the gate or gates 3) is subjected to the comminuting action of the trimming device 79. This is due to the aforediscussed recirculation of surplus tobacco 82 in such a way that the layer 182 is composed (at least to a large extent) of returned surplus tobacco and that the material of the layer 182 is used to form the top portion 78*a* of the stream 78+78*a* which is being conveyed toward the trimming plane 88.

The improved apparatus is susceptible of many additional modifications. For example, the apparatus can be designed for simultaneous making of two or more discrete rod-like fillers. The returned surplus is then recirculated in the same way as described above, i.e., each of several streams contains a first portion of freshly supplied shreds and a second portion of recirculated tobacco which is located on top of the first portion and is acted upon by the respective trimming device.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of producing a continuous rod-like filler from particles of smokable material, comprising the steps of establishing and maintaining a supply of smokable material; continuously drawing a first layer of material from said supply and transporting the first layer in a predetermined direction along an elongated path wherein the first layer has two marginal portions; converting in a first portion of said path successive increments of the first layer into successive increments of a relatively narrow and tall stream which contains a surplus of smokable material; removing the surplus from the stream in a second portion of said path downstream of said first portion so that the remainder of the stream constitutes a continuous filler; and returning the removed surplus into a third portion of said path upstream of said first portion and at one marginal portion of the first layer so that the returned surplus forms a second layer along the first layer and reenters the first portion of said path.

2. The method of claim 1, wherein said transporting step comprises advancing the stream on a conveyor and said converting step includes transferring successive increments of the first layer onto the conveyor prior to transfer of successive increments of the second layer so that the converted first layer is transformed into a first portion of the stream next to the conveyor and the second layer is transformed into a second portion of the stream on top of the first portion.

3. The method of claim 2, wherein said removing step includes removing smokable material from the second portion of the stream.

4. The method of claim 1, wherein said returning step includes placing the second layer immediately adjacent the one marginal portion of the first layer.

5. The method of claim 4, further comprising the step of effecting the transfer of smokable material from the first layer into the second layer when the ratio of smokable material in the first layer to smokable material in the second layer is on the increase.

6. The method of claim 4, further comprising the step of effecting the transfer of smokable material from the second layer into the first layer when the ratio of smokable material in the second layer to smokable material in the first layer is on the increase.

7. The method of claim 1, wherein said transporting step includes advancing the first and second layers next to each other downwardly through a gathering duct upstream of the first portion of said path.

8. The method of claim 1, wherein said transporting step includes pneumatically conveying the first and second layers to the first portion of said path along an arcuate guide surface.

9. The method of claim 8, wherein said conveying step includes pneumatically conveying the first and second layers along an at least partially concave guide surface whereon the first and second layers are advanced along discrete parallel neighboring sections of said path.

10. The method of claim 1, wherein said maintaining step includes admitting into the supply fresh smokable material along a second path at a level above but laterally offset from the surplus which is being returned into the third portion of said path.

11. Apparatus for producing a continuous rod-like filler from particles of smokable material, comprising a source of supply of smokable material; means for continuously drawing a first layer of smokable material from said source and for transporting the first layer in a predetermined direction along an elongated path wherein the first layer has two marginal portions; means for converting in a first portion of said path successive increments of the first layer into successive increments of a relatively narrow and tall stream which contains a surplus of smokable material; means for removing the surplus from the stream in a second portion of said path downstream of said first portion so that the remainder of the stream constitutes a filler; and means for returning the removed surplus into a third portion of said path upstream of said first portion and at one marginal portion of the first layer so that the returned surplus forms a second layer along the first layer and reenters the first portion of said path.

12. The apparatus of claim 11, wherein said transporting means comprises an endless conveyor which receives successive increments of the first and second layers in the first portion of said path.

13. The apparatus of claim 12, wherein said transporting means further comprises means for delivering successive increments of the first layer to said conveyor ahead of successive increments of the second layer so that the converted first layer is transformed into a first portion of the stream next to said conveyor and the second layer is transformed into a second portion of the stream on top of the first portion.

14. The apparatus of claim 13, wherein said removing means includes means for removing smokable material from the second portion of the stream.

15. The apparatus of claim 14, wherein said returning means includes means for placing returned smokable material into immediate proximity of the one marginal portion of the first layer.

16. The apparatus of claim 15, wherein said returning means includes means for delivering surplus material at least close to said source and wherein said path permits migration of surplus material from the second layer into the first layer when the ratio of material in the second layer to material in the first layer is on the increase.

17. The apparatus of claim 15, wherein said returning means includes means for delivering surplus material at least close to said source and wherein said path permits migration of smokable material from the first layer into the second layer when the ratio of material in the second layer to material in the first layer is on the decrease.

18. The apparatus of claim 11, wherein said transporting means includes a duct wherein the first and second layers advance next to each other in a downward direction upstream of the first portion of said path.

19. The apparatus of claim 11, wherein said transporting means includes an arcuate surface and means for pneumatically conveying the first and second layers along said arcuate surface toward the first portion of said path.

20. The apparatus of claim 19, wherein said surface defines parallel first and second neighboring sections of said path for the first and second layers, respectively.

* * * * *